United States Patent [19]

Francis

[11] Patent Number: 4,767,232

[45] Date of Patent: Aug. 30, 1988

[54] HINGE JOINT FOR TUBULAR RAIL AND POST MEMBERS

[75] Inventor: Patrick A. Francis, Troy, Ohio

[73] Assignee: Superior Aluminum Products, Inc., Russia, Ohio

[21] Appl. No.: 46,615

[22] Filed: May 7, 1987

[51] Int. Cl.[4] ..... F16C 11/00

[52] U.S. Cl. ..... 403/91; 403/113; 256/67

[58] Field of Search ..... 403/191, 234, 237, 235, 403/287, 113, 117, 91; 256/67

[56] References Cited

U.S. PATENT DOCUMENTS 4,505,609 3/1985 Vella ..... 403/170 X 4,546,949 10/1985 Millett et al. ..... 403/234 X

*Primary Examiner*—Andrew V. Kundrat

*Attorney, Agent, or Firm*—Biebel, French & Nauman

[57] ABSTRACT

A hinged joint for adjustably connecting tubular handrails to stanchions or posts, in the assembly of stairway railings, include first and second pivotally connected components, one of the components adapted to be mounted to a stanchion or post and the other to a rail, providing for the adjustable angular offset of the rail with respect to the posts. The pivotal components making up the joint each include a semi-spherical and axially-extending hinge portion, which portions terminate in quarter-spherical end surfaces. The respective hinge portion surfaces are received in corresponding mating quarter-spherical sockets formed in the opposite members. A transverse connector adjustable external to the joint permits the first and second members to be set at a predetermined angular position in accordance with the slope of the rail.

5 Claims, 2 Drawing Sheets

HINGE JOINT FOR TUBULAR RAIL AND POST MEMBERS

BACKGROUND OF THE INVENTION

This invention relates to adjustable railings, such as handrailings for inclined slopes, stairways and the like, and more particularly to a two-part joint or connector which is adapted to connect a vertical stanchion or post with an inclined rail, and to provide for adjustment of the relative angular positions thereto.

In the patent of Thurnauer, U.S. Pat. No. 4,150,907 issued Apr. 24, 1979, an interfitting spherical connector assembly is shown which permits a tubular rail to be adjustably mounted on a stanchion. The Thurnauer mechanism has been successful in permitting on-site adjustment of the slope of rails to stanchions, but the mechanism is relatively complicated and costly to make, and also requires that the relatively interfitting components be adjusted as to a desired angle prior to or during assembly. Thurnauer does not provide a rail-to-stanchion adjustable connector which permits locking of the adjustment, after the rails and stanchions have been assembled to the connector The necessity for making the adjustments first unduly complicates the set-up of a handrailing system, and often requires that the assembled components be disassembled and finer adjustments made on site, as necessary, in building up and completing a handrail assembly.

SUMMARY OF THE INVENTION

This invention relate to a joint or a connector for connecting intersecting rails and stanchion members providing for adjustment of the angle of the rail to the stanchion. More particularly, the invention relates to a split-knuckle type of joint, which permits a hollow rail, such as aluminum or other metal tubular rail, to be adjustably positioned with respect to a stanchion, during assembly, and thereafter secured or tightened to the adjusted position.

The preferred form of the invention includes first and second generally cylindrical components. The components, making up the adjustable joint or hinge, each include a first semi-cyindrical portion which terminates in a quarter-spherical surface. Immediately adjacent each of the extending portions there is provided, in each hinge portion, a quarter-spherical socket or recess, to permit the interfitting of the respective parts such that the quarter-spherical end of one joint section is received in the quarter-spherical recess of the other. The side walls of each of the sections, at the sockets, are mutually inclined to provide pivotal movement substantially in one direction from the co-axial or straight-on position to a deflected or angular position, which may be in the order of 38° to 40°.

The interfitting hinge or joint members, when assembled, respectively rotate or mount about a common transverse connector and when so interfitted, are substantially free of gaps or unsightly protruberances. The connector may be loosened to permit the relative angular setting of the interfitting parts, and tightened after assembly in the desired position.

Preferably, one of the hinge sections making up the joint is further formed with a skirt or body of reduced diameter, to be received in telescopic relation to the abutting end of a rail, while the other is formed with a tube-receiving saddle, to be mounted on the side of a cylindrical stanchion post or pipe to form a T-shaped connector.

The connector of this invention is particularly useful for use in non-welded aluminum pipe railing installations, and the connector is preferably formed from turned aluminum castings, having a highly polished outside cylindrical surface compatible with the aluminum tubing used for the rails and stiles.

It is accordingly an object of this invention to provide a split-knuckle type of connector joint, which is externally adjustable and/or lockable, to provide for the connection of an inclined handrail to a post or stanchion.

A further object of the invention is the provision of a coupling arrangement, for rails, such as used in conjunction with stairways or the like, which permits adjustment of the connecting angle between rails and stanchions during assembly, and which provide for retention of the desired position after it has been determined on the site.

A further object is the provision of a connecting joint for rails and stanchions, such as for non-welded aluminum pipe rail systems, in which the connector includes interfitting knuckle portions which provide for pivotal movement, free of unsightly gaps and protruding parts.

These and other objects and advantages of the invention will be apparent from the following description, the accompanying drawings and the appended claims.

DESCRIPTION OF PREFERRED EMBODIMENT

Figure 1:
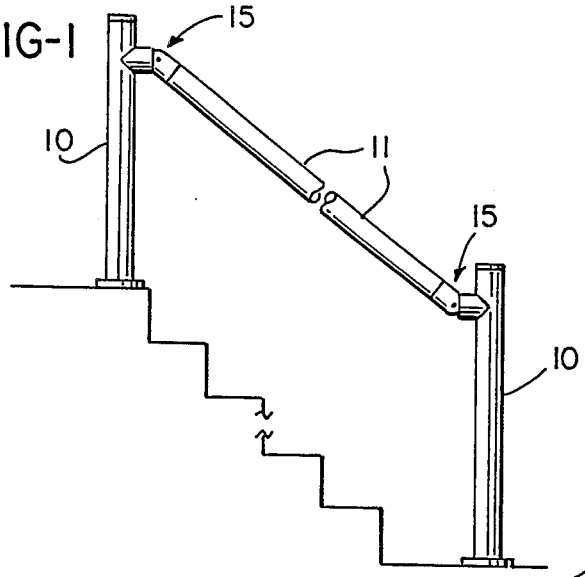
FIG. 1 is a fragmentary elevational view showing one manner of using the joint for supporting the handrail of a stairway.

A railing assembly employing joints made according to this invention is illustrated in FIG. 1 as including upright tubular aluminum stanchions or posts 10, on at each end of a stairway, and an intermediate sloping handrail 11. The split-knuckle joint of this invention couples the sloping handrail to the posts 10. Two of the joints 15 are shown in FIG. 1 for the purpose of illustration, although it may be understood that more such joints may be used wherever upright supports or members are connected with sloping intermediate or railing members, such as the handrail 11. The joint of this invention is particularly adapted for use with tubular members, such as tubular posts and rails, although it is understood that the concept may be used to join and pivot solid members as well.

The split-knuckle type joint includes a first generally cylindrical joint member 20 and a second generally cylindrical interfitting or mating joint member 22. The members 20 and 22 may be made, for example, from aluminum castings.

Figure 2:
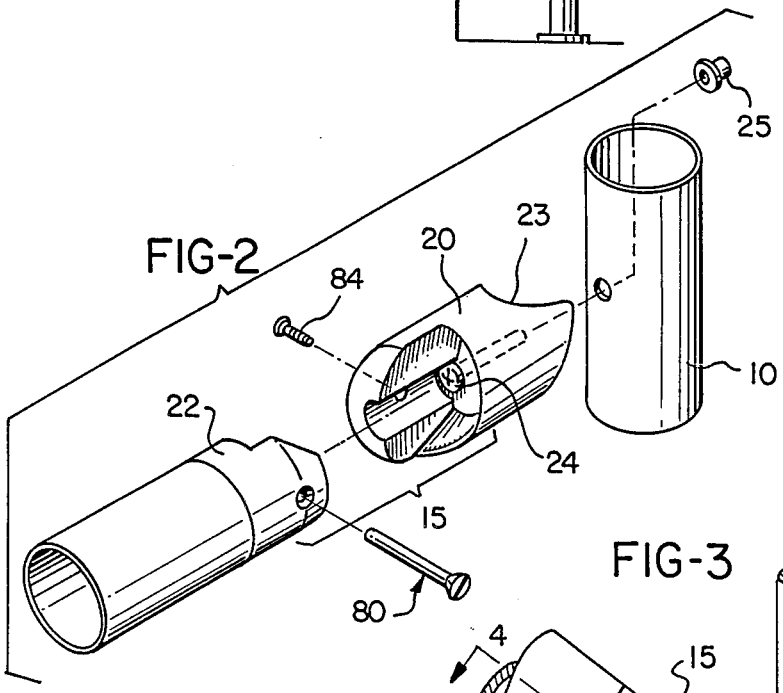
FIG. 2 is an exploded view of the joint of this invention.
Figure 4:
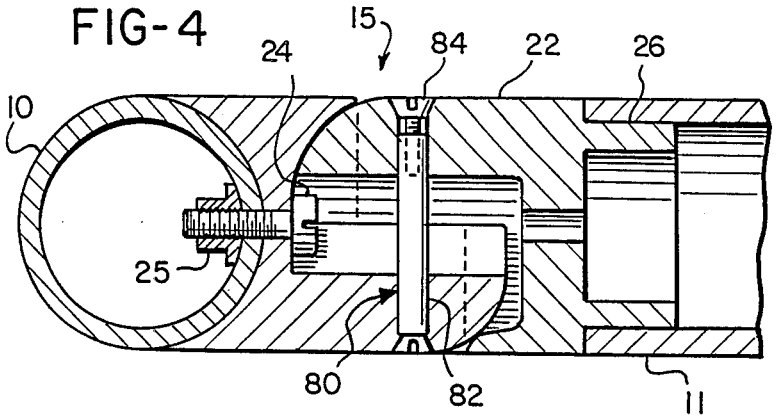
FIG. 4 is an enlarged transverse section through the joint taken generally along the line 4—4 of FIG. 3.
Figure 5:
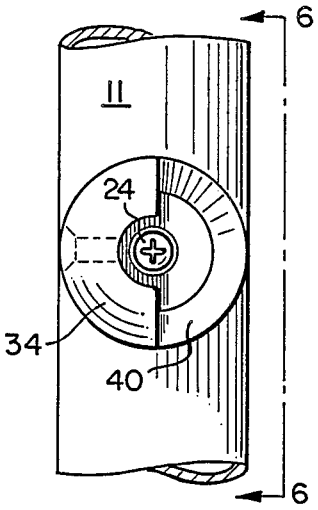
FIG. 5 is an end elevation of the joint member attached to a vertical post.
Figure 6:
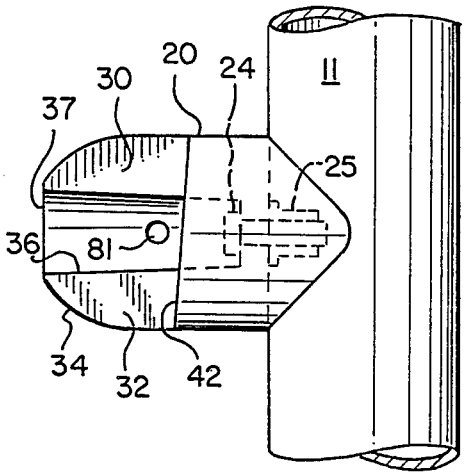
FIG. 6 is a side elevational view of the member of FIG. 5 looking generally along the line 6—6 of FIG. 5.

The first joint member 20 is formed with a cylindrical saddle end 23 adapted to be received over the mating cylindrical surface of a vertical hollow post 10, as shown in FIGS. 2 and 6, and retained in place by a retainer bolt 24 (FIG. 4) and a capturing nut 25 received inside the rail 10 on the bolt 24. The interfitting second joint member 22 is provided with an axially extending coupling skirt 26 adapted to be received in an end of the section of rail 11, as shown in FIG. 4.

Figure 3:
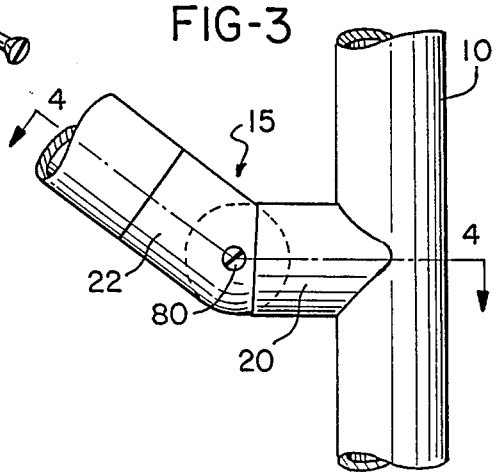
FIG. 3 is a side elevation of the joint after assembly.

The first and second joint members include interfitting and pivotally connected knuckle components of a special design and configuration, so as to provide the appearance of an outer smooth surface and to permit pivotal movement of one of the joint members with respect to the other primarily in one offset direction, such as illustrated in FIG. 3. When pivotal movement in the opposite direction is required, it is only necessary to invert the joint 15. Thus, the first member 20, as shown in FIGS. 2 and 6 has an extended semi-cylindrical hinge portion 30. The portion 30 has an intermediate straight section 32, and terminates in an end 34. The end 34 defines a quarter-cylindrical surface, or, in other words, half of a hemisphere, and further defines an axially central access opening 36 therethrough leading from an outer terminal end 37, to form in effect a blind opening in the base portion, to receive the bolt 24. The first section further defines a one-quarter spherical pocket or socket 40 adjacent the extended portion 30 at the base thereof. The outer wall or edge 42 of the socket 40 is slightly inclined to a true circumferential line.

Figure 7:
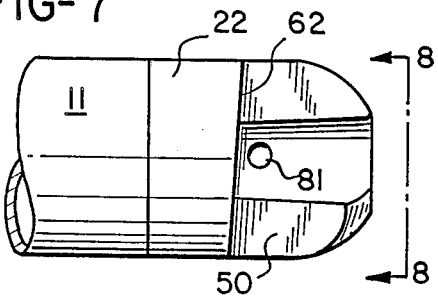
FIG. 7 is a side elevational view of the mating joint member for connection to a rail.
Figure 8:
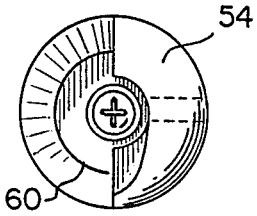
FIG. 8 is a front elevational view looking generally along the line 8—8 of FIG. 7.

The second joint member 22, as shown in FIGS. 7 and 8, is in most respects a mirror image of the first joint member. The second joint member also includes a semi-cylindrical extending hinge portion 50, corresponding to the portion 30, and terminates at a quarter-cylindrical surface 54 on the end, that is, one-half of a hemisphere, corresponding to the surface 34 of the member 20. The axial lengths of the respective portion 30 and 50 are the same. Thus, the second joint member 22 is also provided with an adjacent recess or socket 60 having a quarter-spherical surface immediately adjacent to the semi-cylindrical extended portion 50. The respective sockets 40 and 60 are proportioned to receive the interfitting extended quarter-spherical ends of the other member in internested relation, as shown in FIG. 4. Thus, socket 60 also terminates at an outer inclined or sloping wall 62, and when the parts are so interfitted and pivoted on a common pivot pin 80, the sloping walls permit the pivotal movement primarily in one direction only, as illustrated in FIG. 3. Approximately 38° movement of the second member with respect to the axis of the first member is sufficient for most handrail installations.

The pivot pin 80 comprises connector means which extends through clearance openings 81 in the respective extended hinge sections and joins these sections together in interfitting relation with the respective ends 34 or 54 received in the sockets 60 or 40. The removable pin may preferably comprise a hollow tubular threaded outer member 82 and an interfitting opposite screw 84. Each end thereof is accessible from an outside surface of the fitting 15. The angular adjustment of the respective sections forming the joint may be made with the screw 84 loosened, and after the rail 11 is set with respect to the post or stanchion 10, the joint may be tightened in place. Throughout the provided pivotal movement, the respective nose portions of the interfitting parts are captured within the confines of the receiving quarter-spherical sockets, so that the joint forms a complete circumferential closure substantially free of gaps, and provides an attractive and safe device which does not present any protruding parts.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a joint for connecting intersecting rail members to permit adjustment of the angular relation of such rail members in connecting inclined handrails, for stairways and the like, the improvement comprising:

a first joint member terminating in an extended hinge portion, the terminal end of said portion having a quarter-spherical surface formed on the end thereof, means in said first member defining a quarter spherical socket adjacent said hinge portion, a second generally cylindrical joint member also having an extended hinge portion terminating in a quarter-spherical end proportioned to be received in said socket of said first member, and further having means defining a quarter-spherical socket adjacent said extending portion, said socket being proportioned to receive the quarter-spherical end of said first member, transverse connector means extending through said respective extended hinge portions for joining said members together in interfitting relation with said ends thereof received in said sockets for tilting movement about said transverse connecting means.

2. The joint improvement of claim 1 comprising means in said connector means accessible externally of said joint for locking said members in an adjusted position.

3. A split-knuckle joint for connecting an inclined handrail to a post, comprising:

a generally cylindrical first joint member adapted to be connected to said rail, said first joint member terminating in an extended semi-cylindrical hinge portion, the end of said portion forming a quarter-spherical surface on the end thereof, means in said first member defining a quarter spherical socket adjacent the base of said semi-cylindrical hinge portion, a second, generally cylindrical joint member adapted to be mounted on said post and also having an extended semi-cylindrical hinge portion terminating in a quarter-spherical end proportioned to be received in said socket of said first member, and further having means defining a quarter-spherical socket adjacent said extending portion, proportioned to receive the quarter-spherical end of said first member, the outer walls of each of said sockets being inclined to the circumference thereof providing for the tilting of the axis of said second member with respect to said first member primarily in one direction only, and adjustable connector means extending through said respective extended semi-cylindrical portions for joining said members together in interfitting relation with said ends thereof received in said sockets in predetermined tilted relationship to each other.

4. The joint improvement of claim 3 comprising means in said connector means accessible externally of said joint for locking said members in an adjusted position.

5. A split-knuckle joint for connecting an inclined tubular rail to a post to permit adjustment of the angular relation of such rail such as in connecting inclined handrails along stairways and the like, comprising:

a first joint member adapted to be connected to such rail and having an extended hinge portion, the terminal end of said portion forming a quarter-spherical surface on the end thereof, means in said first member defining a quarter-spherical socket adjacent said hinge portion, a second joint member also having an extended hinge portion terminating in a quarter-spherical end proportioned to be received in said socket of said first member, and further having means defining a quarter-spherical socket adjacent said hinge portion, and proportioned to receive the quarter-spherical end of said first member, connector means extending through said respective extended hinge portions for joining said members together in interfitting relation with said ends thereof received in said sockets for tilting movement thereabout.

* * * * *